United States Patent [19]

Volansky

[11] Patent Number: 4,759,145

[45] Date of Patent: Jul. 26, 1988

[54] BULLET DISPERSING MACHINE GUN

[76] Inventor: Edward P. Volansky, 58 Osborn Rd., Naugatuck, Conn. 06770

[21] Appl. No.: 940,986

[22] Filed: Dec. 15, 1986

[51] Int. Cl.[4] ..... F41C 23/00

[52] U.S. Cl. ..... 42/71.01; 89/41.13

[58] Field of Search ..... 42/71.01, 71.02, 72, 42/73, 75.02, 75.04; 89/41.13, 41.16

[56] References Cited

U.S. PATENT DOCUMENTS

| | | | |
|---|---|---|---|
| 562,487 | 6/1896 | Quackenbush | 42/72 |
| 1,285,253 | 11/1918 | Lepak | 89/41.16 |
| 1,334,983 | 3/1920 | Arter | 89/41.16 |
| 1,353,267 | 9/1920 | Pierce | 89/41.16 |
| 1,551,809 | 9/1925 | Dodge | 89/41.16 |
| 2,631,398 | 3/1953 | Fantoni | 42/73 |
| 3,550,300 | 12/1970 | Roder | 89/41.16 |

*Primary Examiner*—Stephen C. Bentley
*Attorney, Agent, or Firm*—Lawrence Hager

[57] ABSTRACT

A so called machine or automatic gun having a cone shaped device mounted about the gun muzzle, a washer like or ring member slidably affixed to the gun stock, a muzzle blast deflector device and a ball joint swivel device. The muzzle blast causes the muzzle to be deflected about the inner circular confines of the cone. In this manner, a somewhat circular bullet dispersion pattern is obtained. The size of the circular dispersion pattern may be adjusted by forward/rearward movement of the ring member to control the motion of the muzzle during the burst firing.

1 Claim, 2 Drawing Sheets

BULLET DISPERSING MACHINE GUN

FIELD OF THE INVENTION

This invention relates to means to control the firing pattern of automatic or semi-automatic weapons so that the within-the-burst dispersion is modified in a circular pattern of desired manner.

BACKGROUND OF THE INVENTION

Burst compensators are devices attached to the muzzle of a gun to control or alter the motion of the weapon during the firing of a burst.

PRIOR ART STATEMENT

In one prior art device, such as is described in U.S. Pat. No. 4,351,223, issued Sept. 28, 1982 to Edward M. Schmidt, an asymmetric channel forming an extension of approximately one half of the gun's barrel.

Another prior art device, described in U.S. Pat. No. 3,187,632, shows an attachment for deflecting the projectiles after they leave the muzzle.

Other prior art patents of interest include U.S. Pat. Nos.: 2,166,468, issued Jan. 24, 1938 to C. B. Greenstreet; 1,660,595, issued Feb. 25, 1927 to Joseph F. Butler; 3,329,063, issued Apr. 14, 1965 to F. K. Ehrenburg et al; 1,413,903, issued Apr. 25, 1922 to V. H. Czegka.

These patents are mentioned as being representative of the prior art and other pertinent references may exist. None of the above cited patents are deemed to affect the patentability of the present claimed invention.

The present invention involves a novel combination of features combined in such a way as to afford a solution to the difficulties and disadvantages of the prior art while meeting many long felt and unresolved needs of the art field.

For example, in contrast to the prior art, the present invention provides an automatic and/or semi-automatic weapon or so called "machine gun" which is relatively inexpensive, is adapted for ease of use, enables relatively quick encompassing shot pattern projectile distribution, obviates any need for manual rotation of the weapon, has a pattern adjustment means, a barrel rotation means, and a pivot means, is robust and involves a minimum of associated parts to facilitate easy, reliable and relatively trouble free operation.

SUMMARY OF THE INVENTION

An automatic or semi-automatic firearm (10) having particular utility for effecting a circular shot pattern comprising:

a stock (11) having a ball joint receiving socket (12), an elongate barrel mounting member (13) and a trigger-handle window (14);

pattern defining means (15) having a generally cone or conical shaped member (16) affixed about the muzzle, a constraining member (17) slidably mounted about the muzzle, a slide bar (18) operatively connected to said constraining member and to a manually operable handle means (19);

gas actuated/propelled barrel rotator means (20) having a plurality of apertures or channels provided at a predetermined angle relative to the longitudinal axis of the barrel for venting a portion of the propellant gases which emerge after each round leaves the barrel whereby a rotational force is applied to the muzzle or barrel end;

a gun means (21) operatively connected to the barrel and having a ball joint like member (22) swivel/rotatively received within said ball joint receiving socket, and a trigger and handle member (23) movably received within said trigger-handle window.

Accordingly, it is an object of the present invention to provide a new and improved weapon.

Another object of the present invention is to provide a new and improved automatic and/or semi-automatic gun.

Another object of the present invention is to provide an automatic firearm to enable a selective projectile dispersion pattern at the target.

Another object of the present invention is to provide an automatic firearm having means to effect an automatic generally circular dispersion pattern at the target to thereby increase the effectiveness of the firearm through the increase in the target area subject to a burst of fire.

Another object of the present invention is to provide an automatic firearm having means to selectively cause rotation of the muzzle or barrel piece when the firearm is actuated so as to effect rotation of the muzzle in a generally circular pattern having a diameter selectively defined and adjustable so as to enable selective circular pattern size or target area.

Another object of the present invention is to provide an automatic firearm having means to selectively enable substantially uniformly straight or adjustable circular pattern target area.

BRIEF DESCRIPTION OF THE DRAWINGS

Other objects and advantages of the invention may be more clearly seen when viewed in conjunction with the accompanying drawings. Similar reference numerals refer to similar parts throughout.

DESCRIPTION OF THE PREFERRED EMBODIMENT

Figure 1:
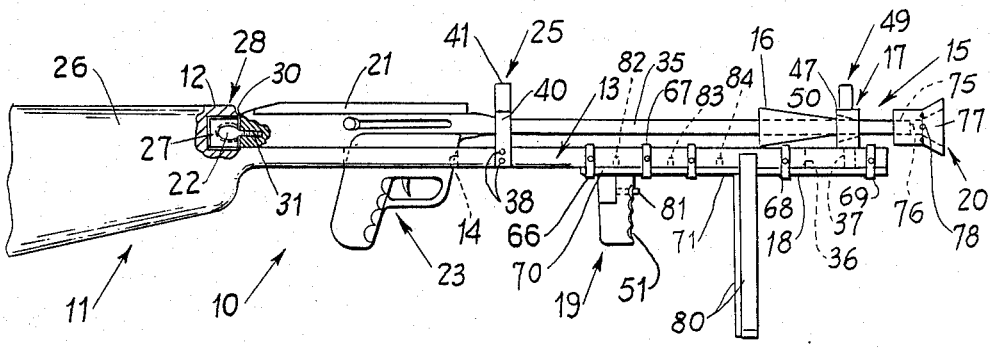
FIG. 1 is a side view of the automatic/semi-automatic firearm in accordance with the invention.

Referring to the drawings, particularly FIG. 1, there is shown an automatic and/or semi-automatic firearm 10 constructed in accordance with the invention to have a robust structure generally comprising a stock 11, an automatic and/or semi-automatic gun mechanism 21, a rear sight member 25, a pattern defining means 15 and a barrel rotator means 20.

Figure 5:
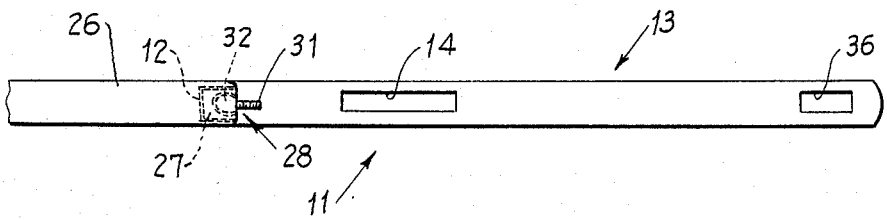
FIG. 5 is a top view, partly in phantom outline, of the stock shown in FIG. 1.
Figure 6:
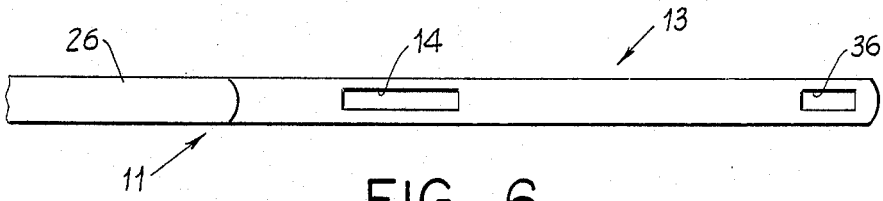
FIG. 6 is a bottom view of the stock shown in FIG. 1.

With reference to FIGS. 1, 5 and 6, the stock 11 basically comprises a shoulder rest member 26, and an elongate support member 13. The shoulder rest member 26 has a recess or alcove 12 dimensioned for receiving the female member or section 27 of a ball joint like member 28. The male portion 22 of ball joint member 28 is affixed to the rear end 30 of gun mechanism 21 by conventional means, for example, stud 31. Ball joint member 28 may be secured to stock 11 in conventional manner, for example, by screws (not shown). A first rectangular shaped hole or window 14 is provided in stock 11, and is dimensioned for loosely receiving trigger-handle 23 therein. The dimensions of window 14 are predetermined, for example, empirically, to enable sufficient clearance for trigger-handle 23 movement with circular rotation of muzzle or barrel 35. A second rectangular shaped hole or window 36 is provided and dimensioned for slidably receiving slide arm 37.

The automatic and/or semi-automatic gun mechanism 21 may be of conventional design, and, therefore, will not be described in detail herein to avoid prolixity. Basically speaking, however, the gun mechanism 21 comprises a bullet chamber and mechanism (not shown) for rapid firing of bullets, a handle and trigger portion 23 and an elongate barrel 35. In accordance with the present invention, the rear end of gun mechanism 21 is affixed to a ball joint 22 of ball joint socket 28 to enable slight rotation thereof. In this manner, the gun mechanism 21 may rotate or swivel as will be discussed more fully hereinafter, with substantially less movement or rocking of the rear of stock 11 against the user's shoulder. Thus, reduced user shoulder injury and improved aim may be obtained due to reduced user required movement.

Rear sight member 25 is affixed to stock 11 by any conventional means such as screws 38. Rear sight member 25 has a pair of downwardly projecting arms 40 and a sight means 41. Arms 40 are affixed on opposite sides of support stock member 13 and about barrel 35, with sufficient clearance for barrel 35 to rotate in accordance with the invention.

Figure 2:
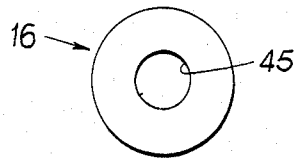
FIG. 2 is a first end view of the cone member shown in FIG. 1.
Figure 3:
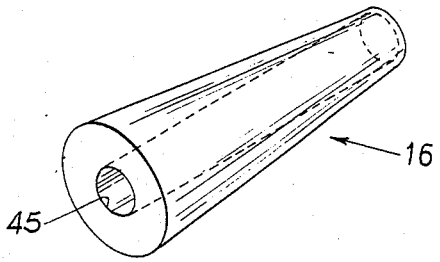
FIG. 3 is a perspective partly in phantom outline view of the cone member shown in FIG. 1.

With reference to FIGS. 1, 2 and 3, cone member 16 generally comprises a metal elongate cone shaped member having a longitudinal bore 45. Bore 45 has a diameter dimensioned for snugly receiving barrel or muzzle 35. Cone 16 is fitted over an end portion of the barrel or muzzle 35 and affixed thereto in conventional manner, for example, welded. The taper of cone 16 may be empirically determined for best desired results.

Figure 9:
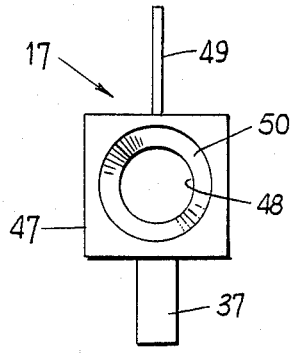
FIG. 9 is a front view of the constraining member shown in FIG. 1.

With particular reference now to FIGS. 1 and 9, constraining member 17 is shown as comprising a nut shape member 47 with a central bore 48, a downwardly projecting slide blade 37 and a front sight member 49. Constraining member 17 may be formed of any suitable metal. The side walls 50 of nut member 47 which define bore 48 may be tapered similar to cone 16, i.e., substantially the same angle of inclinations. In this manner, surface ware is distributed. With the constraining member 17 disposed fully rearwards (see phantom outline) the matting surfaces of cone 16 and constraining member 17 firmly engage to substantially hold the barrel 35 in a fixed position. It should be recognized, however, that bore 48 may, alternatively, be formed to have non-tapered walls similar to a pipe hole. Slide blade 37 may be integrally formed with nut member 47 or affixed thereto by conventional manner such as welding or by screws. Slide blade 37 basically has a rectangular shape and is dimensioned for being slidably received within front window 36 of stock 11. Front sight 49 may be of conventional design and projects upwardly from nut member 47.

Figure 8:
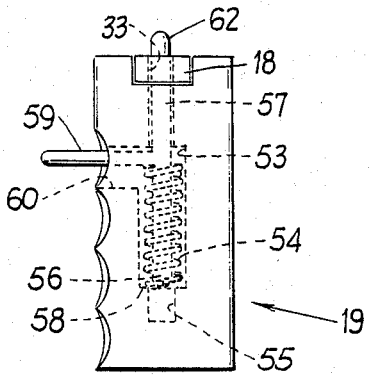
FIG. 8 is a rear view of the adjust handle, partly in phantom outline, and slide bar shown in FIGS. 1 and 7.
Figure 7:
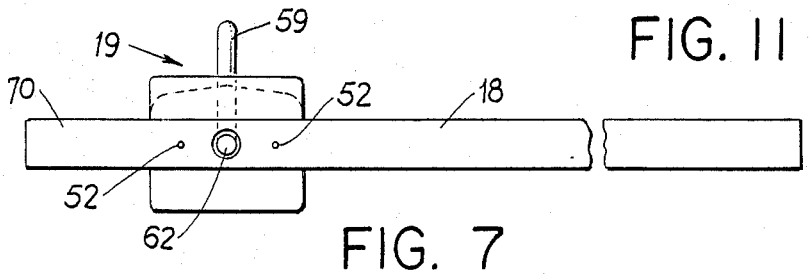
FIG. 7 is a top view of the adjust handle, partly in phantom outline, and slide bar removed from the firearm as shown in FIG. 1.

With particular reference now to FIGS. 1, 7 and 8, the adjust handle 19 and slide bar 18 are shown. Adjust handle 19 may be formed of any suitable material, such as wood or plastic, and has a generally rectangular shape. The front edge of adjust handle 19 may contain finger grips 51 to facilitate gripping. Slide bar 18 has an elongate rectangular bar shape and may be formed, for example, of metal such as steel. Slide bar 18 may be affixed to the top end of adjust handle 19 in conventional manner such as by screws 52. A bore or alcove 53 is provided in adjust handle 19, and is dimensioned for receiving helical spring 54. A lower bore 55 is provided for slidably receiving the bottom end 56 of adjust shaft 57. Ledge portion 58 of bore 53 supports the bottom of spring 54. Adjust shaft 57 extends within the center of helical spring 54 and upwardly through a hole 33 in slide bar 18. An adjust bar 59 is affixed to an intermediate portion of adjust shaft 57, for example, welded, and projects at a normal angle thereto through slide hole 60. Adjust bar 59 projects without adjust handle 19 a predetermined distance to enable user actuation thereof, which will be discussed in greater detail hereinafter.

Helical spring 54 is of such size that in its substantially expanded disposition as shown in FIG. 8 in phantom outline, it extends between ledge 58 and adjust bar 59. Thus, by urging adjust bar 59 downwardly, spring 54 is compressed with tab portion 62 of adjust shaft 57 being recessed below the top surface of slide bar 18.

Figure 10:
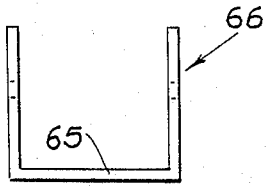
FIG. 10 is a front view of a slider clamp as shown in FIG. 1.
Figure 12:
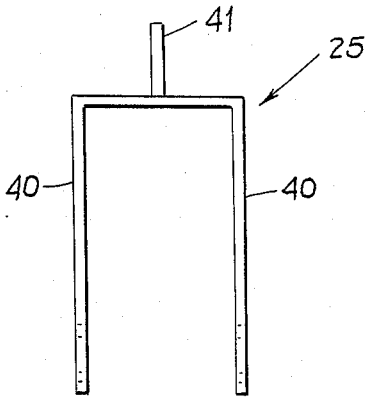
FIG. 12 is a front view of the rear sight member.

With reference now to FIG. 10, a slider clamp is shown. Each slider clamp may be formed of metal and is generally rectangular shaped with a bottom slide bar receiving portion 65. A first slider clamp 66 is affixed about stock portion 13, with its slide bar receiving portion disposed about the rear portion 70 of slide bar 18. A plurality of other slide clamps 67 through 69 are spaced along stock portion 13 to slidably mount slide bar 18 and adjust handle 19 to the bottom side 71 of stock portion 13. In this manner, adjust handle 19 and slide bar 18 may be manually moved or shifted rearwards and forwardly. Slide arm 37 is affixed to slide bar 18 in conventional manner such as by a screw (not shown). Thus, with movement of slide bar 18 backward and forward, constraining member 17 is coincidentally disposed.

Figure 4:
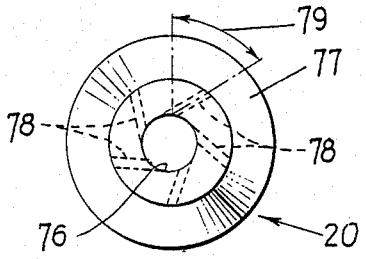
FIG. 4 is an end view of the rotator means illustrating in phantom outline the plurality of angled venting channels shown in FIG. 1.

With reference now to FIGS. 1 and 4, the barrel rotator or flash hider 20 will now be discussed. Barrel rotator 20 may be made of steel or other suitable metal and adapted for being affixed at the end 75 of muzzle or barrel 35. Barrel rotator 20 has a central elongate bore 76 dimensioned to fit at its rear about muzzle end 75 and opening to a cone shaped opening 77. A plurality of smaller gas vent holes 78 are provided at an intermediate section of the flash hider adapter 20. Gas vent holes 78 are drilled at a predetermined angle 79, which may be determined empirically. Gas vent holes 78 are provided to vent a portion of the muzzle exhaust gases during firing. The venting gases through holes 78 imparts a circular motion or force at muzzle end 75. Flash hider adapter 20 may be affixed to muzzle end 75 by conventional means such as welded or screwed together.

A pair of mounting pods or legs 80 may be affixed to stock portion 13. Pods 80 may be of conventional design.

OPERATION

With reference now to the drawings, the operation of machine gun 10 will now be discussed.

Assuming that constraining member 17 is in its rearward most position as shown in phantom outline, cone member 16 and muzzle 35 are held in a fixed, i.e., non-rotating, position. In this manner, machine gun 10 effects a substantially straight firing or bullet pattern similar to a conventional machine gun.

If the operator desires to effect a circular bullet dispersion pattern, he depresses adjust handle lever 59 which causes tab pin 62 to be removed from its rear stock tab receiving hole 82. Next the operator pushes adjust handle 19 forward which causes forward disposition of slide bar 18, slide arm 37 and constraining member 17 toward barrel rotator means 20. A plurality of stock receiving holes, for example, 82, 83 and 84 (shown in phantom outline), are provided. It should be understood that as the constraining member 17 is disposed toward rotator means 20, the spacing between the inner cone shaped wall surface 50 and cone member 16 increases gradually to a maximum spacing with constraining member 17 disposed to its forward most position as shown in solid line. Thus, with adjust handle moved forwardly and the set tab 62 placed in one of the stock receiving holes 82, 83 and 84, the front muzzle 75 is free to move/rotate.

With firing gun 10, muzzle gases are vented partially via holes 78. This muzzle gas venting causes generally circular or tangential forces to be applied to muzzle end 75. With continuous (automatic) firing, muzzle end 75 rotates in a circular pattern defined by the engagement of the cone 16 or muzzle with the inner cone shaped wall surface 50 of constraining member 17.

As noted above, ball joint member 28, and the spacing between trigger mechanism 23, and the spacing between barrel 35 and rear sight 25 permits the muzzle 75 to rotate while the stock is being held in a substantially steady disposition relative to said rotating muzzle 75.

Figure 11:
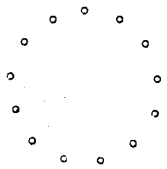
FIG. 11 is a pictorial representation of a shot/projectile pattern in accordance with the invention.

It should be understood that with stock 11 held stationary and muzzle 75 rotating in a circular pattern within and generally defined by bore 48 of constraining member 17, a generally circular shot/projectile pattern is effected such as illustrated in FIG. 11. The diameter of this circular shot pattern being dependant on the distance of the target and selectively on the adjustment position of constraining member 17.

While there has been shown what is considered to be the preferred embodiment of the invention, it is desired to secure in the appended claims all modifications as fall within the spirit and scope of the invention.

For example, the ball joint or swivel means 28 may be affixed at an intermediate position on the barrel and stock. The pattern defining means 15 may remove the cone member from the barrel and an alternative (cone) means not mounted to said barrel but designed to effect the desired constraint pattern of the barrel being dispositioned with barrel gas venting during burst firing. Also, the concept of this invention may be utilized for laser and/or particle beam type weapons.

I claim:

1. An automatic and semi-automatic firearm having particular utility for effecting a circular shot pattern comprising:

a stock (11) having a ball joint receiving socket (12), an elongate barrel mounting member (13), wall portions defining a slide arm window (36) and a trigger handle window (14);

firearm means (21) having an elongate barrel (35), a ball joint member (22), a trigger handle means (23), said firearm means being operatively mounted to said stock with said ball joint member being received within said ball joint receiving socket, and with said trigger handle means movably received and projecting through said trigger handle window;

shot pattern defining means (15) having a generally cone shaped member (16) affixed about said barrel, a constraining member (17) having a nut shape member (47) with wall portions (50) defining a central conically shaped bore (48) and a downwardly projecting slide arm (37) projecting through said slide arm window (36), and having an adjustment handle means (19) containing a slide bar (18) affixed to said slide arm;

gas actuated/propelled barrel rotator means (20) having a plurality of channels (78) at a predetermined angle relative to the longitudinal axis of said barrel (35).

* * * * *